United States Patent [19]

Watanabe et al.

[11] 4,365,542

[45] Dec. 28, 1982

[54] ELECTRIC FAN

[75] Inventors: Kenichi Watanabe; Hiroshi Kinoshita; Akira Tatsumi, all of Hitachi; Koichi Goto, Yamagata, all of Japan

[73] Assignee: Hitachi, Ltd., Tokyo, Japan

[21] Appl. No.: 244,677

[22] Filed: Mar. 17, 1981

[30] Foreign Application Priority Data

Mar. 17, 1980 [JP] Japan ..... 55-33784[U]

[51] Int. Cl.[3] ..... F24F 13/08

[52] U.S. Cl. ..... 98/40 V; 98/121 A

[58] Field of Search ..... 98/40 V, 40 E, 107, 98/110, 121 A, 94 AC, 94 R; 310/39

[56] References Cited

U.S. PATENT DOCUMENTS

| | | | |
|---|---|---|---|
| 2,759,411 | 8/1956 | Jenson | 98/40 V |
| 3,213,301 | 10/1965 | Jepson et al. | 310/39 X |
| 3,380,372 | 4/1968 | Perry | 98/40 V X |
| 3,481,534 | 12/1969 | Price | 98/40 V X |
| 3,777,650 | 12/1973 | Wenig | 98/40 V |
| 4,123,197 | 10/1978 | Keem et al. | 415/123 |

FOREIGN PATENT DOCUMENTS 128748 9/1979 Japan .

*Primary Examiner*—William E. Tapolcai

*Attorney, Agent, or Firm*—Antonelli, Terry and Wands

[57] ABSTRACT

An electric fan having a rotary grille provided with a plurality of inclined grille plates and a small-sized reversibly rotatable synchronous electric motor adapted to rotatively drive the rotary grille. A plurality of pairs of projections are formed on a peripheral portion of the rotary grille at different distances from the center of the rotary grille and at different angular intervals. A slidable stopper is mounted on the frame of the electric fan. The stopper is adjustably positionable so as to enable engagement with selected one of the pairs of projections or to a position where it does not contact the projections, so that the rotary grille is reciprocatingly rotated within an angular range limited by the projections or rotated continuously in one direction to vary the area or region of application of an air flow.

5 Claims, 2 Drawing Figures

ELECTRIC FAN

BACKGROUND OF THE INVENTION

The present invention relates to an electric fan having a grille including a multiplicity of inclined grille plates for deflecting the flow of air generated by the fan. The electric fan of the invention can suitably be used as a floor or desk-top type fan, wall-hung type fan or as a ventilation fan mounted in a window to induce fresh outdoor air into the room.

Such an electric fan has been proposed as having means for changing the direction of air flow in relation to time, in order to attain a pleasant flow of air well resembling natural wind.

A typical example of such an electric fan is the so-called oscillation type electric fan in which an electric motor, to which a fan blade unit is connected directly, is oscillated in a horizontal plane to change the direction of flow of air in relation to time. Another example of such an electric fan is the so-called rotary grille type fan in which a rotary grille having a number of grille plates is rotated at a low speed, while the direction of the motor is kept unchanged, to change the direction of flow of air in relation to time. The latter type of electric fan is disclosed, for example, in the U.S. Pat. No. 4,123,197.

The oscillation type electric fan, however, has various drawbacks. Namely, the direction of flow of air can be changed only horizontally, because the motor oscillates only in a horizontal plate. In addition, since a complicated link mechanism is required for the oscillatory motion of the motor, the electric fan is difficult to produce and is susceptible to a malfunctioning of the link mechanism.

The rotary grille type electric fan has an extremely simple construction because the rotary grille is rotated at a low speed simply by a small-sized electric motor. This type of electric fan, however, has a disadvantage that the flow of air is directed also to the area where there is no person who would receive and benefit from the air flow.

SUMMARY OF THE INVENTION

It is, therefore, an object of the invention to provide an electric fan having a rotary grille capable of changing the area of application of air flow by a simple construction.

To this end, according to the invention, an electric fan is provided having a rotary grille in which the rotary grille is driven by a small-sized synchronous motor having no definite direction of rotation, and in which the range or angle of rotation of the rotary grille is limited by a stopper provided on a stationary part of the electric fan and adapted to contact with selected one of a plurality of projections formed on the rotary grille. When the stopper is contacted by the selected one of the projections, the reactional force is applied to the synchronous motor to reverse the latter so that the rotary grille is reciprocatingly rotated within a selected angular range.

DESCRIPTION OF THE PREFERRED EMBODIMENTS

Figure 1:
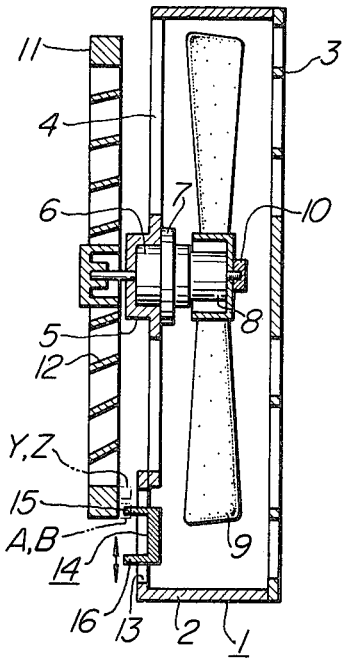
FIG. 1 is a vertical cross sectional view of an electric fan constructed in accordance with an embodiment of the invention, with the mounting or attaching members being omitted.

A preferred embodiment of the invention will be described hereinunder with reference to the accompanying drawings.

Referring to the drawings, the electric fan of the invention has a box-shaped frame 1, accommodating an electrically driven fan unit to be described more fully hereinbelow, with the frame 1 having a square or rectangular body 2, a suction grille 3, provided at the rear end of the body 2, and a plurality of radially extending support arms 4 provided on the front end of the body 2. A hub 5 having a container recess, formed in the center of the frame 1 unitarily with the latter, for receiving small-sized synchronous motor 6 having a built-in reduction gear. A motor support 7 is attached in such a manner as to cover the synchronous motor 6. A single-phase induction motor 8 is mounted on the motor support 7, and a fan blade unit 9 is secured to the shaft of the induction motor 8 by means of a stopper nut 10. The small-sized synchronous motor 6 is a reversibly rotatably motor having a single-phase stator coil, that is, if the rotor (not shown) of the synchronous motor 6 is stopped for any external force or obstruction, the rotor starts to rotate in a reverse direction.

A circular rotary grille 11 is fixed to the output shaft of the small-sized synchronous motor 6 extends through the hub 5. The rotary grille 11 includes a plurality of inclined grille plates 12 and, the rotary grille 11, as a whole, is formed as a unit from a plastic material to have engaging portions, which may be in the form of integral projections A, B and Y, Z formed on the rear face of a peripheral portion thereof. The projections A and B are disposed at a radially outer side of the projections Y and Z, with an angle formed between the projections A and B around the center of the rotary grille being 180°, while an angle formed between the projections Y and Z around the center of the rotary grille is 90° (270°).

Figure 2:
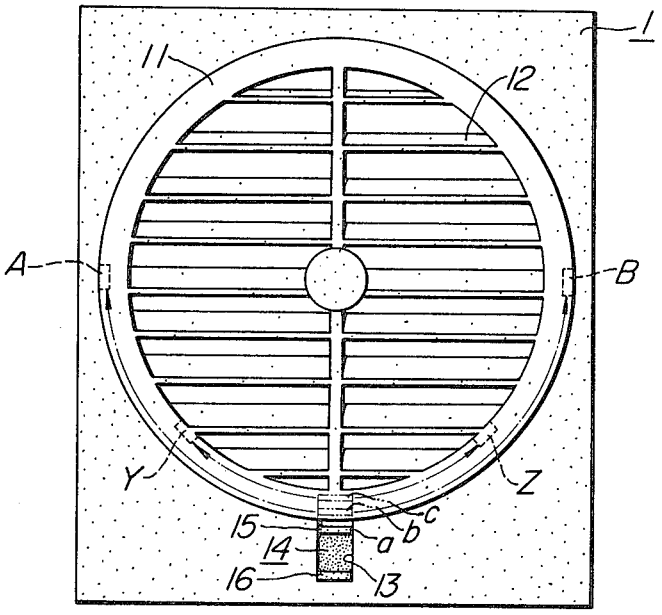
FIG. 2 is a front elevational view of the electric fan of FIG. 1.

An elongated slot 13 permits a stopper 14 to be slid up and down in the direction of the arrow in FIG. 1. The stopper 14 is provided with a retainer portion 15 and a knob portion 16. The arrangement is such that the retainer portion 15 can be moved to and stopped at one of the three positions described below, by a manual operation of the knob portion 16. Namely, as shown in FIG. 2, the knob portion 16 can be displaced to a position a which does not reach the locus of movement of the projections A, B a position b which reaches the locus of movement of the projections A, B; and a position c which reach the projections Y, Z.

In operation, as the electric power is supplied to the motor 8, the fan blade unit 9 is rotated to induce air to be drawn in from the rearward suction grille 3, and be directed through the rotary grille 11 by the fan blade unit 9 imparting kinetic energy to the drawn in air to forcibly displace the latter forwardly through the rotary grille 11. Since the rotary grille 11 has a plurality of inclined grille plates 12 disposed at the front side of the fan blade unit 9, the air flow displaced by the fan blade unit 9 is deflected in accordance with the rotational position or condition of operation of the rotary grille 11.

Assuming here that the small-sized synchronous motor 6 is not operating, the rotary grille 11 is maintained stationary, because the stationary friction torque of the driving mechanism for driving the rotary grille 11, including the small-sized synchronous motor 6, is large enough to prevent the rotary grille 11 from being rotated by the flow of air displaced by the fan blade unit 9. When the rotary grille 11 is maintained at the position shown in the drawings, the air flow is continuously directed downwardly. This position at which the rotary grille 11 is stopped, however, can be selected and determined freely as required. The position of the stopper 14 has nothing to do with the determination of the stopping position of the rotary grille 11.

As the small-sized synchronous motor 6 is started by a manipulation of a control switch (not shown), while the fan blade unit 9 is rotating, the flow of air from the fan blade unit 9 is deflected by the rotary grille 11 which is now rotated by the synchronous motor 6. It is possible to obtain three different patterns of air flow or wind, depending on the position of the stopper 14. Namely, if the knob 16 of the stopper 14 is operated manually to bring the retainer portion 15 to the position a, the rotary grille 11 rotates continuously in one direction, because the retainer portion 15 does not reach the locus of projections A, B nor the locus of the projections Y, Z of the rotary grille 11. In this state, the air flow has a conical form diverging forwardly around the axis of the fan blade unit 9.

If the stopper 14 is manually operated to bring the retainer portion 15 to the position b, the retainer portion 15 is contacted by, for example, the projection B as the rotary grille 11 rotates, to prevent the further rotation of the latter. Consequently, the small-sized synchronous motor 6 is reversed due to the characteristic peculiar to this synchronous motor 6 to rotate the rotary grille 11 in the reverse direction. This reverse rotation of the rotary grille 11 is continued until the retainer portion 15 comes into abutment with the projection B. Namely, as the retainer portion 15 is brought into abutment with the projection B, the small-sized synchronous motor 6 is reversed again, i.e. starts to rotate in the forward direction, for the same reason. Consequently, the rotary grille 11 is rotated reciprocatingly within the angular range of 180° between the projections A and B. Although in the illustrated embodiment the air flow is directed downwardly over an area of 180°, it is possible to provide an arrangement for directing the air flow upwardly if necessary.

More specifically, when the electric fan is hung from a wall or attached to an window, it is preferred to direct the air flow downwardly, while, when the electric fan is used as a floor type fan to apply the air to a user seated on a seat, the air flow is preferably directed upwardly.

If the stopper 14 is manipulated to position the retainer portion 15 at the position c, the rotary grille 11 is rotated between the projections Y and Z to direct the air flow downwardly over an area of 90°, which is the angle formed between these projections Y and Z.

The ranges of angle of rotation of the rotary grille 11, which are 180° and 90° in the illustrated embodiment, can be varied as desired by changing the angles formed between the two pairs projections A, B, and Y, Z.

In the illustrated embodiment, the two pairs of projections A, B and Y, Z are formed at different angular interval so as to have different loci of movement. This arrangement, however, is not exclusive and it is possible to dispose all of the projections on the same locus or path. In this case, different pairs of projections have different height and the stopper 14 is provided with a plurality of retainer portions 15 of different heights.

From the foregoing description, it will be understood that the present invention provides an electric fan having a rotary grille 11 in which the area of region of application of air flow can be varied by an extremely simple mechanism.

What is claimed is

1. In an electric fan having a frame, an electric motor attached to said frame, a fan blade unit adapted to be driven by said electric motor, a rotary grille disposed in front of said fan blade unit and provided with a plurality of inclined grille plates, and means for rotatively driving said rotary grille at a low speed;

an improvement comprising engaging means formed on said rotary grille, stopper means located at said frame and adapted to be brought into engagement with said engaging means for limiting an angular rotational range of said rotary grille, said means for rotatively driving said rotary grille including a small-sized reversible synchronous motor, wherein a direction of rotation of the synchronous motor is reversed and a position of said rotary grille is changed when said engaging means are brought into engagement with said stopper means.

2. An electric fan as claimed in claim 1, wherein said engaging means are of a varying height and are disposed along the same loci of movement, and wherein said stopper means includes a plurality of retaininer portions of varying heights corresponding to the respective heights of said engaging means, said stopper means being adapted to be movable into and out of engagement with said engaging means.

3. An electric fan as claimed in claim 1, wherein said engaging means are formed in a plurality of pairs having different loci of movement and different angular intervals, and wherein the stopper means is adapted to be movable into and out of the locus of movement of said engaging means.

4. An electric fan having a frame, an electric motor attached to said frame, a fan blade unit adapted to be driven by said electric motor, a rotary grille disposed in front of said fan blade unit and provided with a plurality of inclined grille plates, and means for rotatively driving said rotary grille at a low speed, said means for rotatively driving including a small sized reversible synchronous motor, and means for limiting an angular range of rotation of said rotary grille including a plurality of projections formed on said rotary grille at different angular positions, and a stopper mounted on said frame, said stopper having a retainer portion which is movable into and out of a locus of movement of said projections.

5. An electric fan as claimed in claim 4, wherein said projections are formed in a plurality of pairs having different loci of movement and different angular intervals.

* * * * *